US005249820A

United States Patent [19]

Burger et al.

[11] Patent Number: 5,249,820

[45] Date of Patent: Oct. 5, 1993

[54] FRONT SOLE HOLDING DEVICE

[75] Inventors: Simon Burger; Norbert Eugler, both of Karlsfeld, Fed. Rep. of Germany

[73] Assignee: silvretta-sherpas Sportartikel GmbH & Co. KG, Rothschwaige, Fed. Rep. of Germany

[21] Appl. No.: 666,239

[22] Filed: Mar. 8, 1991

[30] Foreign Application Priority Data

Mar. 10, 1990 [DE] Fed. Rep. of Germany ..... 4007667

[51] Int. Cl.[5] ..... A63C 9/00

[52] U.S. Cl. ..... 280/614; 280/615

[58] Field of Search ..... 280/614, 615, 618, 626, 280/628, 620, 634

[56] References Cited

U.S. PATENT DOCUMENTS 3,944,237 3/1976 Teague ..... 280/618
4,632,419 12/1986 Zoor ..... 280/614

FOREIGN PATENT DOCUMENTS 3539315 9/1986 Fed. Rep. of Germany ..... 280/614
2567409 1/1986 France ..... 280/614

*Primary Examiner*—David M. Mitchell
*Attorney, Agent, or Firm*—McAulay Fisher Nissen Goldberg & Kiel

[57] ABSTRACT

The front sole holding device comprises a support bearing which is rotatably supported in lateral bearing blocks which are fixed with respect to the ski, the ski boot resting on the support bearing in a positive-locking manner in the cross-country skiing position. In order to achieve this positive-locking engagement, the boot sole comprises a recess which is adapted to the support bearing constructed as a straight-line shaft, the support bearing fitting into the recess. A tightener lever serves to hold the boot on this support bearing, which tightener lever is swivelably supported by means of tension bars and comprises, at its free end, a pressure piece which presses on the overlapping edge of the boot sole in its closing position, in which the tightener lever is located in a top dead center position. For downhill skiing the boot is placed directly on the ski and the tightener lever is swiveled under the support bearing and comprises, at its end located opposite the pressure piece, a sole hold-down device which overlaps the upper edge of the sole in the downhill skiing position. The tightener lever is held by means of the support bearing under which it is swiveled for the downhill skiing position in order that the tightener lever, which is swivelably supported at the tension bars, cannot be deflected upward.

6 Claims, 11 Drawing Sheets

FRONT SOLE HOLDING DEVICE

BACKGROUND OF THE INVENTION a) Field of the Invention

The invention is directed to a front sole holding device according to the preamble of claim 1.

b) Background Art

A front sole holding device is already known (DE-PS 34 37 725) which is suitable for cross-country skiing, as well as for downhill skiing, and can be converted in a corresponding manner. According to a preferred construction of this known sole holding device, a plug-in axle is provided which is held in lateral bearing blocks, the front edge of the sole of the ski boot being slid under the plug-in axle for downhill skiing, wherein the plug-in axle serves as a sole hold-down device and is inserted through the bearing bore holes of the bearing blocks, as well as through a bearing bore hole in the ski boot sole, for cross-country skiing. A disadvantage in this construction consists, on the one hand, in the fact that the plug-in axle, as a loose part, can get lost when converting the binding from cross-country skiing to downhill skiing and vice versa. Further, the bearing bore hole in the ski boot can become obstructed as a result of snow and ice, so that it is difficult to guide the plug-in axle through this bearing bore hole. Finally, it can be cumbersome in difficult terrain to hold the ski boot at a distance over the surface of the ski in such a way that the bearing bore holes are aligned in the bearing blocks and the bearing bore hole in the boot sole in order to insert the plug-in axle.

A ski binding is already known (U.S. Pat. No. 4,392,666) in which a reinsertion at the front sole holding device when changing from cross-country skiing to downhill skiing is unnecessary, since the front support bearing remains in the same position with respect to the ski boot for both types of use; however, a special mounting is required at the sole of the boot in this binding. This mounting comprises a base body which is screwed on at the sole of the boot and two lateral holders which are constructed so as to be resilient and cooperate with an axle held on a bearing block, wherein the axle is rounded at its ends and the holders comprise cup-like recesses for receiving these ends. The ski boot is accordingly held at a distance from the ski surface, so that cross-country skiing is possible. However, a disadvantage consists in the fact that special mountings making up a part of the bindings are required at the boot, which mountings render the ski boot unsuitable for use without the ski, i.e. for traversing terrain. An additional protection for this binding part arranged on the ski boot is required even for short distances, so that loose parts are again present.

The problem described above does not exist in another known ski binding (DE-OS 22 31 058), since no mounting parts which constantly remain on the boot are necessary; but in this case the ski boot is securely connected with an additional plate by means of a swivel axle projecting through the boot sole, which additional plate comprises a recess in the front area in order to make it possible to swivel the boot relative to this additional plate. This additional plate is clamped into the jaws of a conventional downhill ski binding, wherein the ski boot can be secured in the heel area relative to this additional plate for downhill skiing. As was also the case in the known binding already discussed in the beginning, a disadvantage in this construction consists in that a plug-in axle must be guided through the sole of the boot, which brings up the problems related to such a plug-in axle which were mentioned in the beginning

OBJECT OF THE INVENTION

A primary object of the invention is to design a sole holding device of the type discussed in the beginning in such a way that it can easily be converted from cross-country skiing to downhill skiing, comprises no loose parts and is not sensitive to icing up.

SUMMARY OF THE INVENTION

This object is met, according to the invention, proceeding from a sole holding device, in that the support bearing supports the ski boot from below for cross-country skiing, wherein the ski boot can be placed on the support bearing from above, and in that a clamping device is supported so as to be swivelable at a part connected with the ski, which clamping device acts at the overlapping edge of the sole from above and clamps the ski boot on the support bearing in a positive-locking or friction-locking manner.

In particular, this construction has the advantage that the ski boot is only placed on the support bearing in a simple manner for cross-country skiing and clamped by means of the clamping device. Accordingly, the ski boot can be secured on the ski in a particularly simple manner for cross-country skiing without the need to insert loose parts into a bearing bore hole, since the invention provides that the ski boot is only placed on the support bearing and clamped there by means of a simple clamping device. This construction is also not sensitive to the influences of snow and ice and can be used in a simple manner for downhill skiing, for which purpose there are a number of possibilities which will be discussed in the following.

In principle, a particularly simple construction can be selected for downhill skiing if the support bearing is at a distance from the surface of the ski in such a way that it overlaps the projecting edge of the sole in the downhill skiing position. An additional sole hold-down device for the downhill skiing position is accordingly superfluous.

A construction which is simple and reliable, as well as easy to operate, results in a further development of the invention in that the clamping device is constructed as a two-armed tightener lever which is supported so as to be swivelable by means of tension bars, which act in an articulated manner at the tightener and are supported in an articulated manner so as to be fixed with respect to the ski, and comprises a pressure piece at one of its free ends, which pressure piece presses on the upper edge of the sole in the cross-country skiing position, wherein the point of support of the pressure piece on the sole is located outside the plane of the tension bars at the side remote of the ski boot. Thus, this is a simple tightener lever which is located in its top dead center position in the clamped position.

If the support bearing is constructed as a straight-line shaft which is held in lateral bearing blocks, a particularly simple possibility for using this sole holding device for downhill skiing consists in that the edge of the sole is simply pushed under the shaft and the ski boot is held in this position by the rear sole holding device. In so doing, the distance of the shaft from the surface of the ski is selected in such a way that the front edge of the sole, whose height is usually standardized, fits under the shaft.

The distance of the shaft from the surface of the ski can be adjustable so that the ski boot does not have too great a distance from the surface of the ski in the cross-country skiing position.

The shaft can be held so as to be displaceable in the longitudinal direction of the ski in a further construction of the invention in order to ensure that the ski boot does not collide with the rear sole holding device in the cross-country skiing position and in order to ensure that the ski boot cannot be additionally secured by means of the rear sole holding device in the cross-country skiing position, in which the ski boot is securely connected with the front sole holding device.

In the downhill skiing position, however, the boot can also be held in a different manner. According to a particularly advantageous construction of the invention, the tightener lever can carry a sole hold-down device at its other free end located opposite the pressure piece, which sole hold-down device is adapted to the boot sole and cooperates with the edge of the sole in the downhill skiing position, wherein the tightener lever can be locked in the downhill skiing position against vertical swiveling by means of a locking device.

Instead of the adjustability of the straight-line shaft, the support bearing can be constructed as a U-shaped shaft with bearing pins which are bent outward at the free ends of the legs and rotatably supported in lateral bearing blocks in order to achieve the least possible distance of the sole of the boot from the surface of the ski in the cross-country skiing position and for shifting the ski boot in the longitudinal direction in the cross-country skiing position in order to release it from the rear sole holding device.

With this U-shaped and bent shaft, the ski boot is only at that distance from the surface of the ski in the swiveled down position which is necessary in order for the ski boot to be freely displaceable in the cross-country skiing position. For the downhill skiing position, this U-shaped shaft is swiveled upward, wherein there are further possibilities again in this case for holding the boot in the downhill skiing position.

A first possibility consists in that, in connection with a tightener lever which comprises a sole hold-down device, the tightener level for the downhill skiing position is swivelable under the support bearing which serves as a locking device, and in that the end of the tightener lever carrying the pressure piece is supported on the ski. This possibility for using the two-armed tightener lever also exists in the construction with the straight-line shaft, wherein the latter has a great enough distance from the ski surface so that either the tightener lever is swivelable under the shaft or the shaft is adjustable in the vertical direction.

In another construction of the invention, the end of the tightener lever carrying the pressure piece can be supportable in the downhill skiing position on a stop, which is arranged on the ski so as to be vertically adjustable, in order to be able to adjust the height of the sole hold-down device in an advantageous manner.

However, the U-shaped shaft can also be used with a simple tightener lever which comprises the pressure piece for clamping in the cross-country skiing position only on one side when, in a further construction of the invention, the base part of the U-shaped shaft is bent in an S-shaped manner in the plane lying parallel to the ski surface, wherein the middle area is adapted to the rounded portion of the toe of the boot above the toe of the boot in the swiveled up position serving for downhill skiing. Thus, in this construction, the support bearing itself, which is constructed as a U-shaped shaft, serves as a sole hold-down device in the downhill skiing position.

In order that the tightener lever, in its function as sole hold-down device in the downhill skiing position, always arrives in the same position in which the sole hold-down device constructed at one end has a determined distance from the surface of the ski, it is provided in a further construction of the invention that a control surface is formed on the arm of the tightener lever carrying the sole hold-down device, the underside of the support bearing resting on this control surface, and the control surface is constructed so as to slope upward in the direction facing away from the ski boot.

A simplified construction of the sole holding device consists in that the tension bars of the tightener lever act at the support bearing so as to avoid an additional bearing for the tension bars insofar as the support bearing is constructed so as to be swivelable, which is particularly advantageous. In a swivelable construction of the support bearing, the support bearing moves in bearings of bearing blocks when swiveling the boot up and down during cross-country skiing, which results in a particularly low friction resistance for the swiveling movement. Of course, the support bearing could also be rigidly arranged. In this case, the rolling movement of the boot would produce a friction between the boot sole and the support bearing during cross-country skiing, which leads to higher friction coefficients if special precautions are not taken.

In order to limit the swiveling position of the tightener lever in the clamping position, stops which cooperate at the support bearing and at the tightener lever can be provided in an advantageous manner in order to define the top dead center position of the tightener lever.

If a control cam which cooperates with a pressure piece, which is resiliently guided in the tightener lever, is arranged at the swivel axis of the tightener lever in a further construction of the invention, it is ensured that after opening the tightener lever, the latter also always arrives in its predetermined open position in which the insertion of the ski boot is not impeded.

It is not absolutely necessary that the support bearing extend over the entire width of the sole of the boot. Rather, it is possible according to another construction of the invention that the support bearing comprises two pins which are located opposite one another coaxially and are held at lateral bearing blocks.

In another construction of the invention the pins comprise bent portions directed downward toward the surface of the ski, which is advantageous for securing the tightener lever in its downhill skiing position when, in another construction of the invention, the tightener lever comprises two lateral recesses in the vicinity of the end carrying the sole hold-down device, which recesses extend over only a part of the thickness of the tightener lever, the pins engaging in the recesses with their bent portions in the downhill skiing position of the tightener lever and serving as a locking device for the latter. The construction of the pins with bent portions also leads to an improved positive-locking connection between them and the sole of the boot in the cross-country skiing position when the latter is provided with corresponding recesses in which these pins engage, as will be explained in more detail in the following.

In order to ensure a secure holding of the boot in spite of the simple type of fastening of the boot on the support bearing, the sole of the boot can advantageously comprise a recess which opens downward and is adapted to the support bearing for the purpose of the positive-locking connection of the ski boot and support bearing.

A particularly advantageous construction results in connection with the U-shaped shaft in that the sole of the boot comprises continuous cut out portions in the laterally overlapping edges for the positive-locking connection of the ski boot and sole holding device, which cut out portions extend vertically relative to the surface of the sole and are adapted to the side legs of the U-shaped shaft. This also makes it possible to climb into the binding without difficulty, even if the cut out portions are clogged with snow and ice, since these continuously open cut out portions are pressed free by the side legs of the U-shaped shaft by means of placing the boot on top.

These positive-locking connections naturally presuppose a correspondingly constructed ski boot. Insofar as this is not the case, the support bearing can be constructed as a swivelably supported footboard for the purpose of the friction-locking connection of the ski boot and the sole holding device, which footboard projects forward at both side in the longitudinal direction of the ski over its swivel axis, wherein the portion directed toward the end of the ski projects over the swivel axis substantially further than the portion directed toward the tip of the ski. This division of the overlapping portions is advisable in order to be able to swivel the tightener lever under the footboard with its arm carrying the sole holder for the downhill skiing position.

If the support bearing comprises two pins which lie opposite one another coaxially, the boot sole can comprise cut out portions in the laterally overlapping edges in order to achieve a positive-locking connection of the ski boot and support bearing, which cut out portions open downward and are adapted to the pins. In this construction, the pins are supported in the cut out portions, which are closed at the top, and prevent a shifting of the boot in the longitudinal direction of the ski as well as a twisting relative to the ski. This possibility of turning is likewise advantageously prevented by means of the other positive-locking connections discussed above.

The invention is explained in the following with reference to a number of embodiment examples.

DESCRIPTION OF THE PREFERRED EMBODIMENTS

Figure 1:
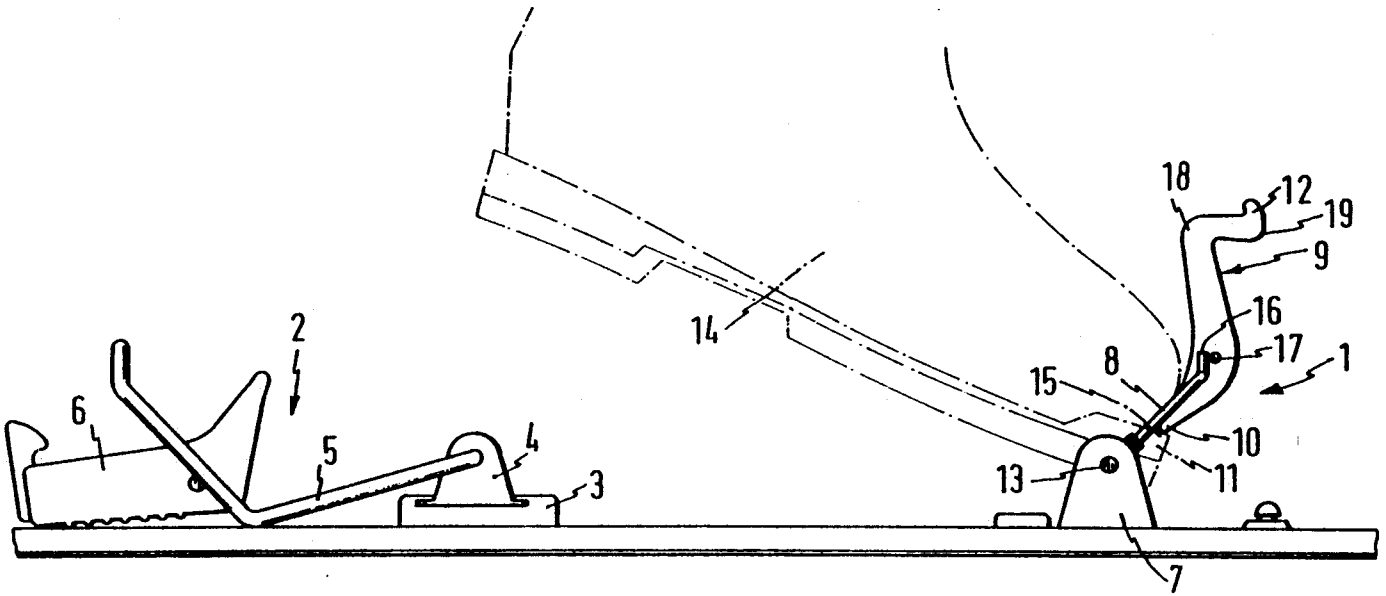
FIG. 1 shows a side view of a cross-country and downhill binding in the cross-country skiing position.
Figure 2:
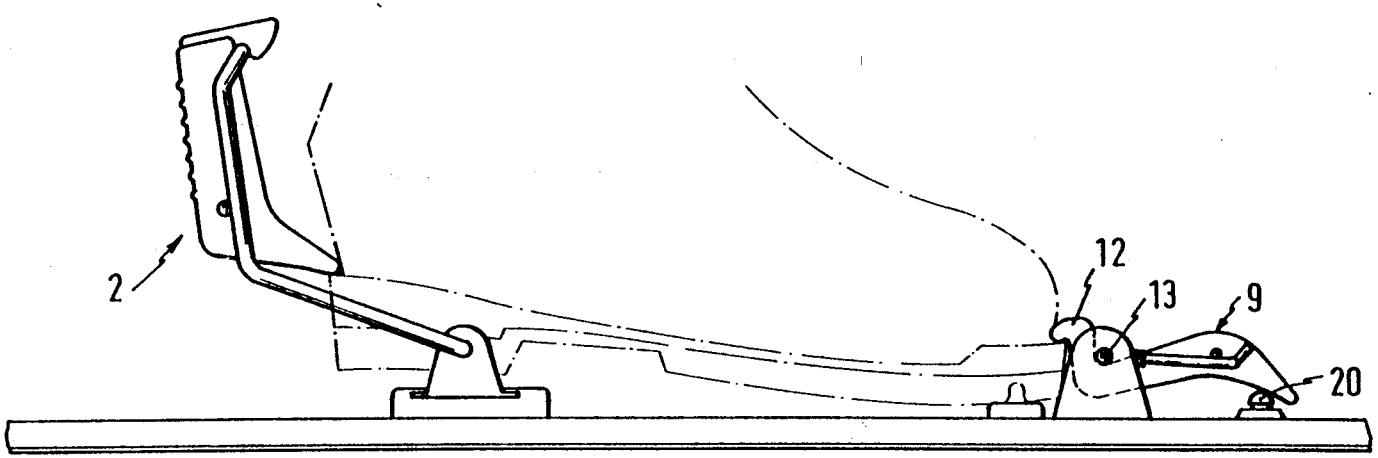
FIG. 2 shows this binding in the downhill skiing position.

FIGS. 1 and 2 show a complete ski binding which comprises a front sole holding device, designated in its entirety by 1, and a rear sole holding device which is designated in its entirety by 2. The rear sole holding device 2 comprises a detachable carriage 4 which is guided transversely relative to the longitudinal direction of the ski in a holder 3, which is fixed with respect to the ski; a swivelable stirrup 5 is supported at the carriage 4 and carries a sole tightener 6 serving for the vertical detaching. Such a sole holding device is known and is therefore not discussed in more detail.

Figure 3:
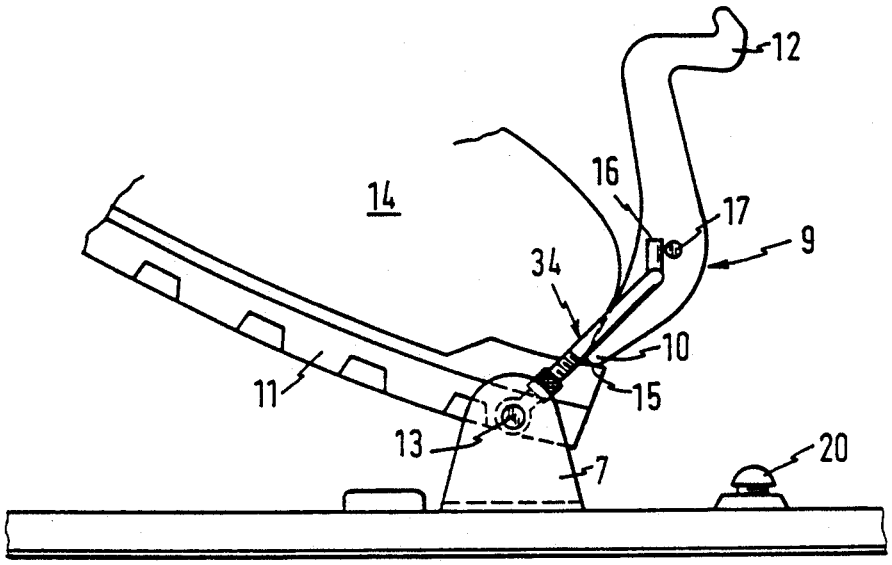
FIG. 3 shows an individual view of the front sole holding device of the binding, according to FIG. 1, in the cross-country skiing position.
Figure 4:
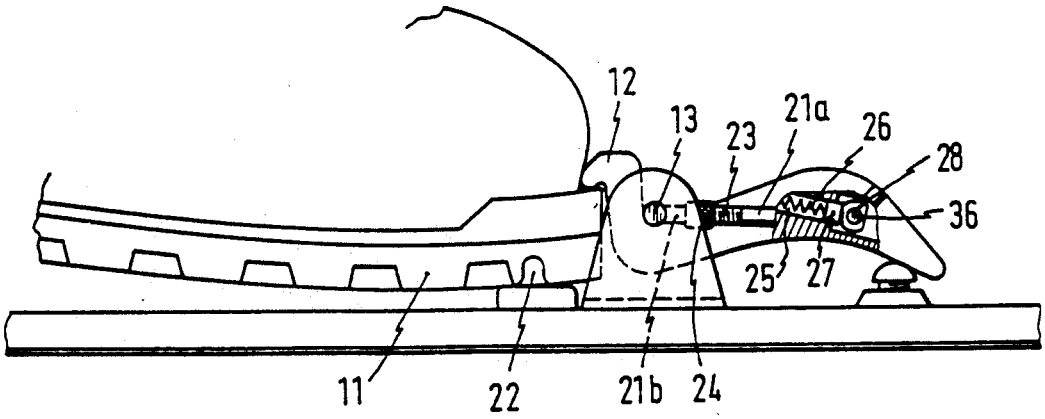
FIG. 4 shows a sole holding device according to FIG. 3 in the downhill skiing position.

The front sole holding device, designated in its entirety by 1, is a first embodiment form which is shown in enlarged scale in FIGS. 3 and 4 and comprises two lateral bearing blocks 7 which are arranged so as to be fixed with respect to the ski two tension bars 8 being held at the bearing blocks 7 and connected with a shaft which is supported in the bearing blocks so as to be rotatable and serves as a support bearing 13 for the sole of the boot in the cross-country skiing position. The tension bars form the legs of a U-shaped stirrup 34, whose base part serves as the bearing axle 36 for a two-armed tightener lever 9. The tightener lever 9 is provided at one end with a pressure piece 10 which is adapted to the rounded portion of the toe of the boot and, in the cross-country skiing position, presses on the upper side of a boot sole 11 which projects forward. The opposite free end of the two-armed tightener lever is provided with a sole hold-down device 12 which is constructed so as to be bent, is adapted to the front boot area and secures the sole edge 11 in the downhill skiing position shown in FIG. 2 against lifting off the ski.

In the cross-country skiing position shown in FIGS. 1 and 3, the tightener lever 9 is located in a top dead center position in which the point 15 of contact is located outside of the plane defined by the tension bars 9. Stops 16 and 17, which define the swiveling movement in the direction of the ski boot 14, are arranged at the tension bars 8 and at the tightener lever 9 so that the tightener lever 9 cannot be further swiveled toward the shoe. A certain resistance must be overcome until the dead center point is reached for opening the tightener lever.

The tightener lever swivels under the support bearing 13 with its end carrying the sole hold-down device 12 for downhill skiing. In order to swivel the tightener lever under the support bearing on the one hand and nevertheless use the end as a sole hold-down device on the other hand, this end is bent twice, wherein the first bent portion is designated by 18 and the second bent portion is designated by 19. Accordingly, the sole hold-down device 12 has the necessary distance relative to the ski surface, so that the sole edge 11 can be slid under the sole hold-down device 12 in the downhill skiing position. In this position, the boot is held by means of the rear sole holding device 2 which enables both a lateral and a vertical detachment, so that the front sole holding device need not have any detaching function. The end of the tightener lever 9 provided with the pressure piece 10 is supported in the downhill skiing position on a vertically adjustable stop which is arranged on the ski, so that the distance of the sole hold-down device 12 is adjustable relative to the surface of the ski. The tightener lever is prevented from swiveling up in the downhill skiing position around the axle 36, around which the tightener lever 9 is rotatably supported, in that the tightener lever 9 is supported from below against the support bearing 13.

The boot sole comprises a recess 22 at its underside, which opens downward and is adapted to the support bearing 13 constructed as a shaft, so that the boot is secured against a displacement or crossing relative to the longitudinal axis of the ski in the cross-country skiing position in which it rests on the support bearing 13 with the sole 11 in the front toe area. The tension bars 8 are constructed in two parts, wherein one part 21*a* assigned to the tightener lever 9 is provided with a threaded piece 23 and the other part 21*b* assigned to the support bearing 13 is provided with a union nut 24 in order to effect a longitudinal adjustability of these tension bars 8. A pressure spring 26 is provided inside the tightener lever in a bore hole 25, which pressure spring 26 is supported against a pressure piece 27 which projects out of the bore hole and cooperates with a control cam 28 which is arranged on the swivel axis 36 of the tightener lever. The control cam 28 is constructed in such a way that, in connection with the pressure piece 27, it holds the tightener lever 8 in the open position in a swivel position as far away as possible from the boot so as not to impede climbing into the binding. i.e. so as not to impede the insertion of the recess 22 on the support bearing 13, which recess 22 is provided in the boot sole. After closing the tightener lever, the ski boot is in the cross-country skiing position. In this position, the ski boot 14 can be swiveled during cross-country skiing, since it has the necessary distance from the surface of the ski due to the support bearing 13, wherein the swiveling movement of the ski boot is reinforced by means of the rotatability of the support bearing.

Another embodiment form of a front sole holding device is shown in FIGS. 5 to 11. The basic construction of the tightener lever corresponds to that of the embodiment form of FIGS. 1 to 4, so that the corresponding parts are provided with the same reference numbers.

The most important difference between the embodiment forms according to FIGS. 1 to 4 consists in that the support bearing designated by 29 is constructed as a U-shaped shaft which comprises a base part 30, two side legs 31 and bearing pins 32 at the ends of the legs, which bearing pins 32 are bent outward and supported so as to be swivelable in lateral bearing blocks 33. The boot can be held at a slight distance from the surface of the ski by means of this bent construction of the support bearing 29, since the support bearing, which serves simultaneously as a locking device for the tightener lever 9 in the downhill skiing position, can be swiveled upward as can be seen from FIG. 9. The necessary distance for swiveling the tightener lever under the support bearing is provided by means of this.

Due to the great distance of the support bearing from the ski in the swiveled up position, it is also possible to construct the sole hold-down device without a bend and accordingly in a simpler manner.

In this embodiment form, the tension bars 8 of the stirrup, designated in its entirety by 34, are arranged so as to be articulated at the legs 31 of the support bearing 29 by means of swivel bearings 35, wherein the base part 36 of the stirrup, designated in its entirety by 34, forms the swivel axis for the tightener lever 9.

Figure 5:
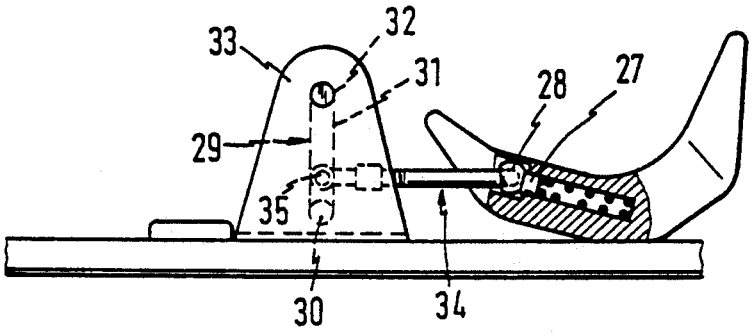
FIG. 5 shows another embodiment form of a front sole holding device in the opened position.

In the open position shown in FIG. 5, the tightener lever 9 is held by means of the cooperation of the pressure piece 27 and control cam 28 so as not to impede climbing into the binding.

Figure 6:
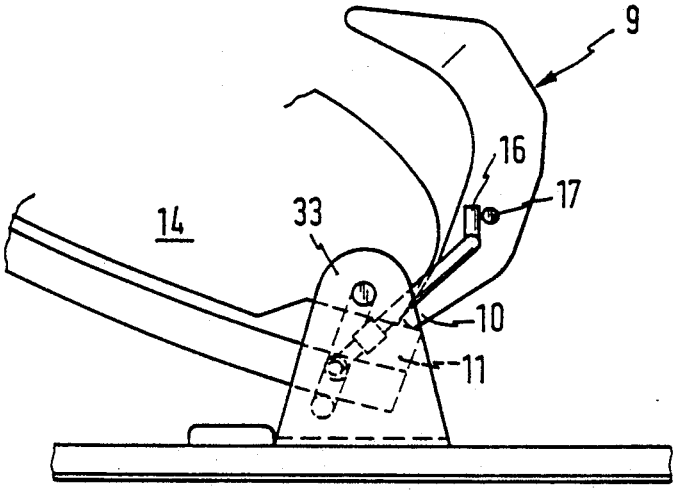
FIG. 6 shows the front sole holding device according to FIG. 5 in the cross-country skiing position.
Figure 7:
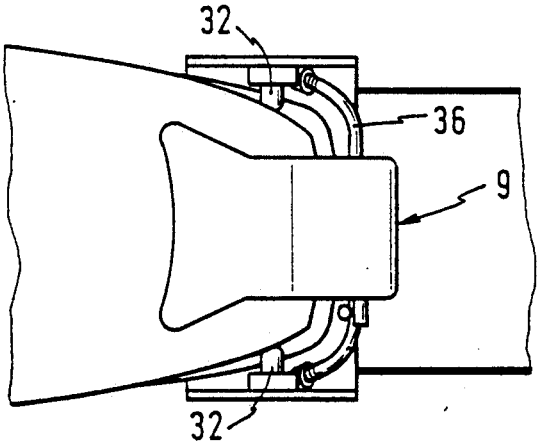
FIG. 7 shows a top view of the sole holding device according to FIG. 6.
Figure 8:
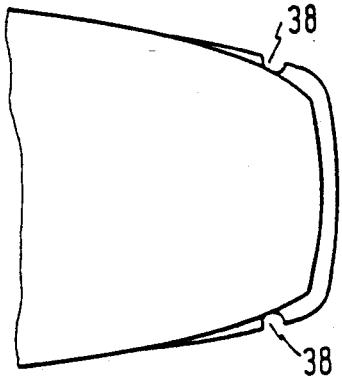
FIG. 8 shows a top view of the front area of the ski boot contained in FIG. 7.
Figure 9:
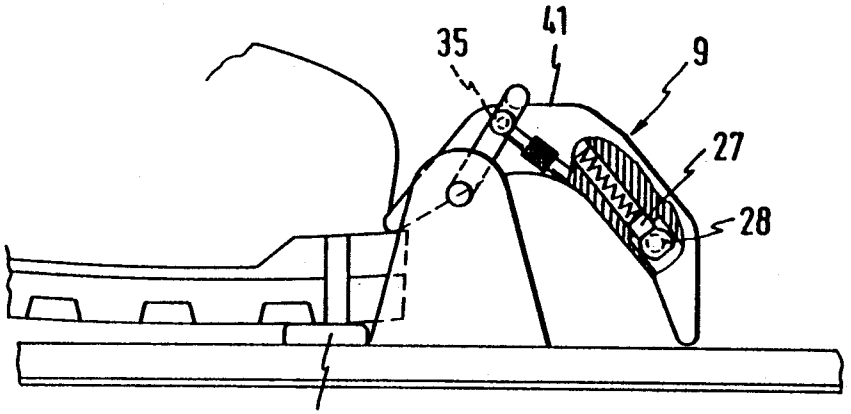
FIG. 9 shows a side view of the front sole holding device according to FIG. 5 in the downhill skiing position, partially in section.
Figure 11:
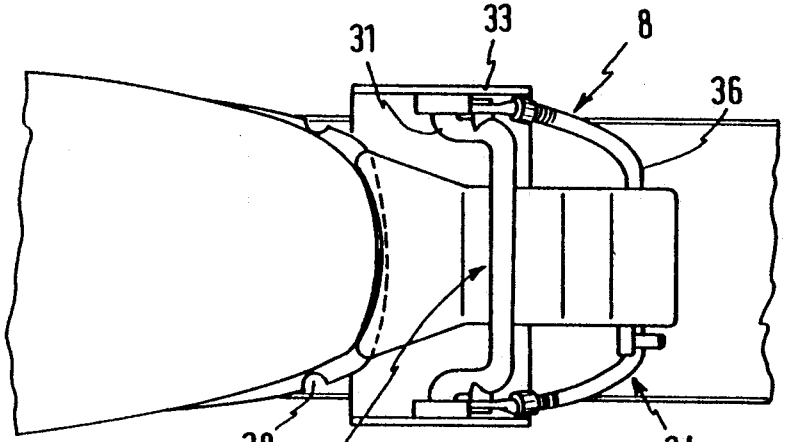
FIG. 11 shows a top view of the sole holding device according to FIG. 9.
Figure 10:
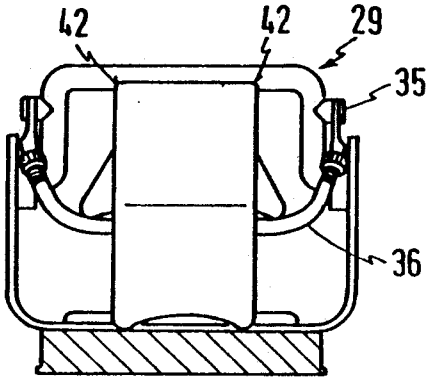
FIG. 10 shows a front view of the sole holding device according to FIG. 9.
Figure 12:
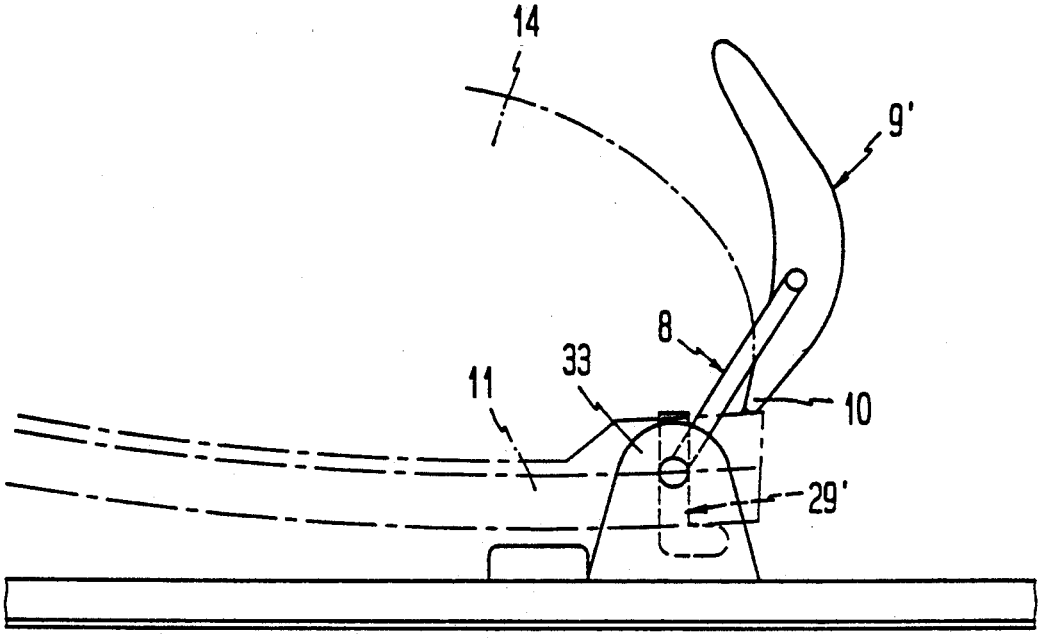
FIG. 12 shows another embodiment form of a front sole holding device in the cross-country skiing position.
Figure 13:
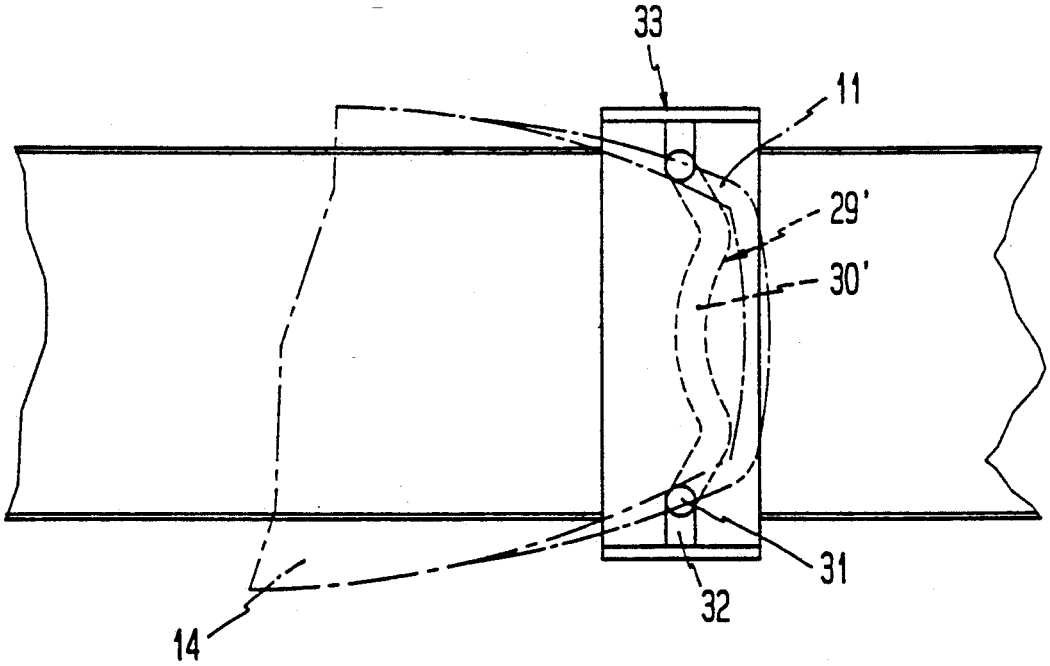
FIG. 13 shows a top view of the sole holding device, according o FIG. 12, in which a binding part is omitted.
Figure 14:
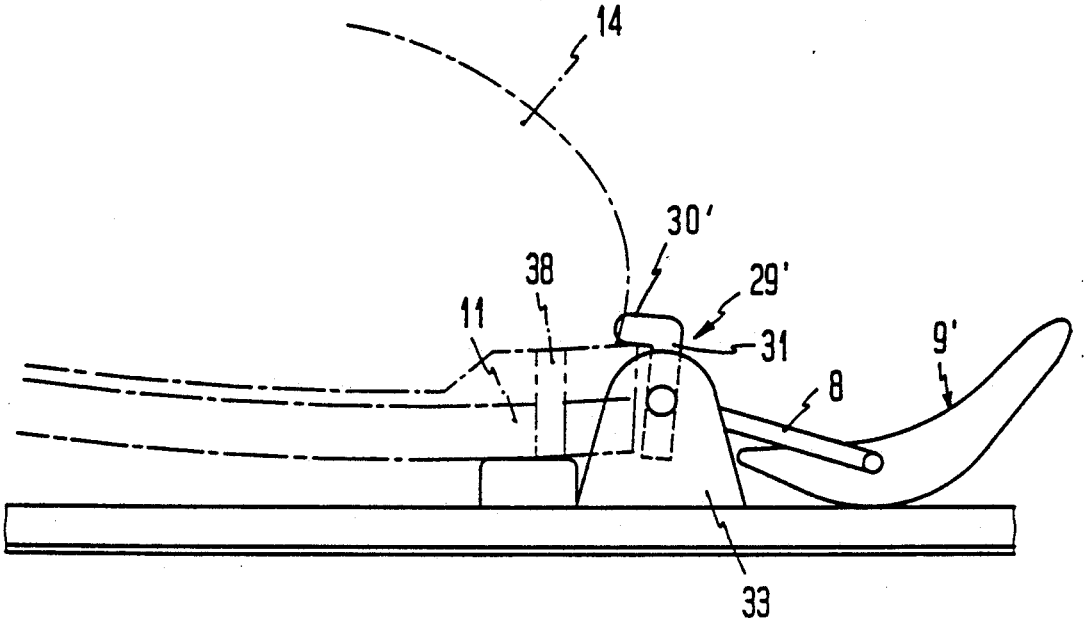
FIG. 14 shows a side view of the front sole holding device according to FIG. 12 in the downhill skiing position.

In the cross-country skiing position shown in FIGS. 6 and 7, the ski boot rests on the base part 30 of the support bearing 29 with the sole, wherein continuous cut out portions 38 which are constructed in the boot sole 11 so as to extend horizontally relative to the latter 11 cooperate with the side legs 31 of the support bearing 29 in such a way that these legs engage in the cut out portions 38 and accordingly bring about a positive-locking engagement between the boot sole and support bearing, so that a longitudinal displacement and a crossing of the boot relative to the ski is not possible, with the exception of the relative movement which the boot executes together with the support bearing 29 during the swiveling of the latter when the boot is lifted while cross-country skiing, as follows from the comparison of FIGS. 5 and 6. When the boot swivels, the U-shaped support bearing is swiveled toward the rear in the direction of the rear end of the ski. In the cross-country skiing position the tightener lever 9 is located in its top dead center position, as was described already in connection with FIGS. 1 to 4. The cut out portions 38 are open in a continuous manner, so that snow which may possibly be pressed into the latter is pressed out toward the top by means of the side legs 31 when climbing into the binding. Accordingly, problems cannot arise when the recesses 38 are covered with ice.

For the downhill skiing position, the boot rests in its front area on a sliding strip 39, which is fixed with respect to the ski, and is held from the top by means of the tightener lever 9 which comprises a sole hold-down device 40 at one end, the sole hold-down device 40 being formed on in one piece and adapted to the shape of the boot. In this position, the tightener lever 9 is located under the support bearing 29, which is swiveled upward, in order to cooperate with a control surface 41 on the tightener lever 9, which control surface 41 is constructed so as to rise diagonally toward the front in the direction of the tip of the ski, so that the swivelable support bearing 29 can be adjusted in a determined position, which ensures that the distance of the sole hold-down device 40 from the surface of the ski assumes a continuously constant value. Centering shoulders 42 which prevent a lateral displacement of the tightener lever 9 on its swivel axis 36 are provided at the base part 30 so that the tightener lever 9 is fixed in its middle position.

Figure 15:
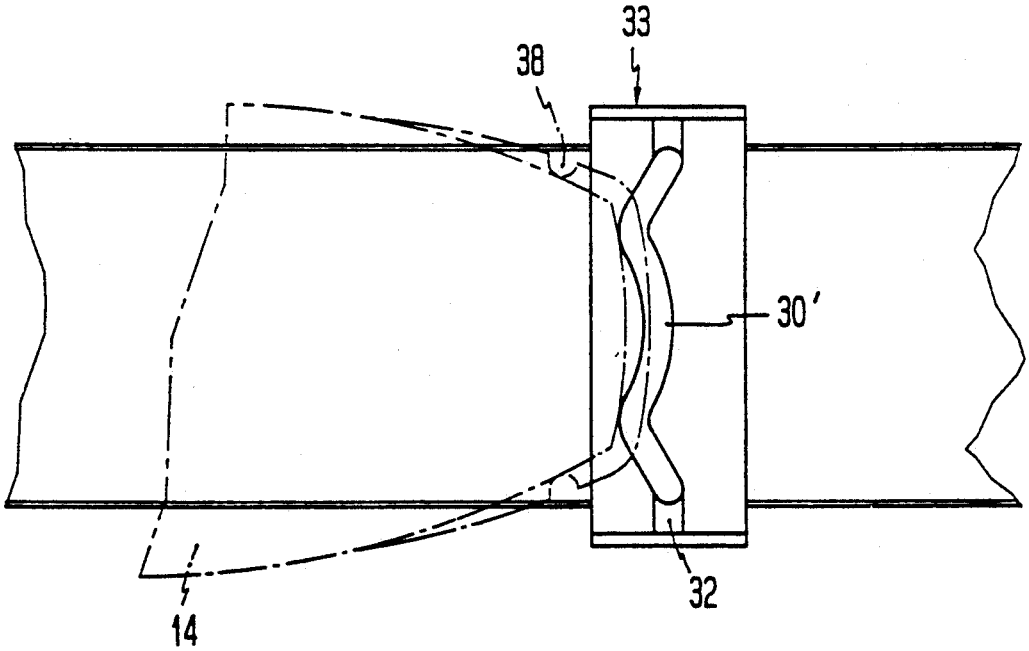
FIG. 15 shows a top view of the sole holding device, according to FIG. 14, in which a binding part is omitted.

Another modification of the front sole holding device is shown in FIGS. 12 to 15. In this embodiment form, the base part 30' of the support bearing 29' is bent in an S-shaped manner in the plane parallel to the surface of the ski, so that it can serve as a sole hold-down device in the swiveled up position corresponding to FIG. 14, wherein the shape of this base part is adapted to the shape of the shoe above the overlapping sole edge 11. In this construction, the tightener lever 9' is only provided with the pressure piece 10 at one end and accordingly serves only to hold the ski boot in the cross-country skiing position, as follows from FIG. 12. In this case also, the side legs 31 of the support bearing 29' engage in the lateral recesses 38 of the boot sole 11. In so doing, the boot sole rests on the base part 30' of the support bearing 29', as follows from FIGS. 12 and 13. In the downhill skiing position the sole of the boot is slid under the base part 30' of the support bearing 29' and the boot is pressed from the rear by means of the sole holding device 2 against the support bearing 29' which serves as a sole hold-down device 2 in the swiveled up position corresponding to the view in FIG. 2. FIG. 15 shows how the support bearing is adapted to the shape of the boot. In this position, the tightener lever 9' is laid down on the ski in front, of the boot. In this connection, reference is made to FIG. 14. The support bearing 29' corresponds to the support bearing 29 according to FIGS. 2 to 11, except for the S-shaped construction of the base part 30', and is also likewise supported.

Figure 16:
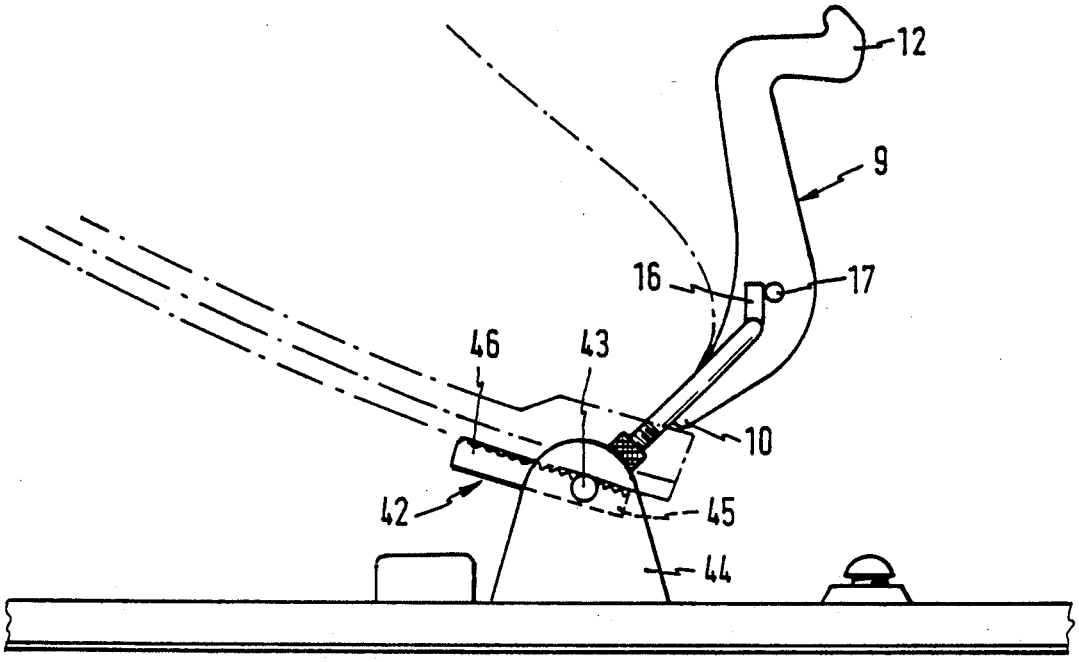
FIG. 16 shows another embodiment form of a front sole holding device in the cross-country skiing position.
Figure 17:
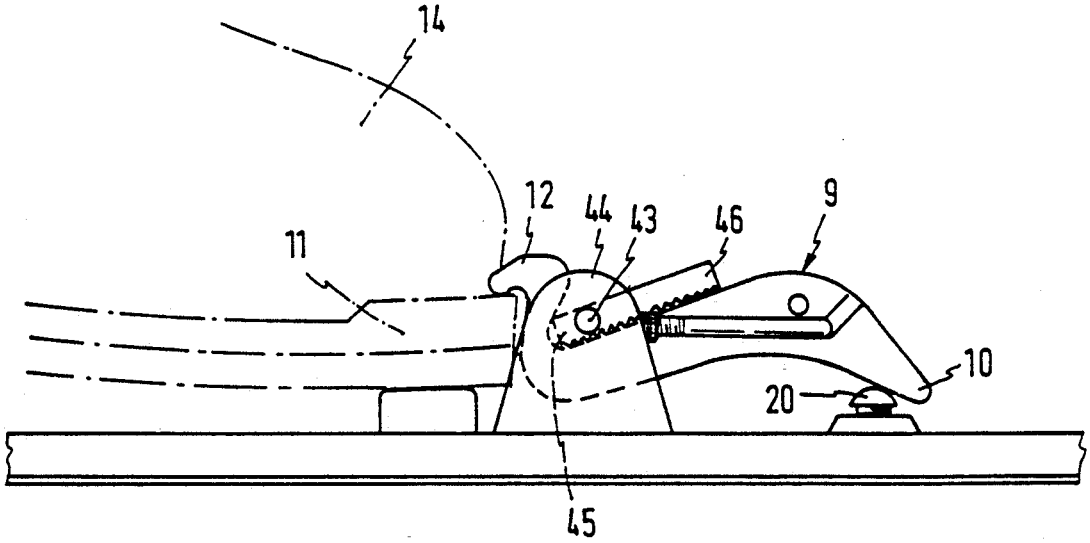
FIG. 17 shows a side view of this sole holding device in the downhill skiing position.

Whereas in the previous embodiment forms a positive-locking engagement was produced between the boot sole and the support bearing so that the boot can be securely held in the cross-country skiing position, FIGS. 16 and 17 show a construction in which the boot is held on the support bearing in a friction-locking manner. In this embodiment form, the support bearing is constructed as a swivelably supported footboard 42 which is supported in bearing blocks 44 by means of a swivel axle 43. The footboard 42 projects over the swivel axle 43 in the longitudinal direction of the ski on both sides, wherein the portion 45 projecting toward the front is substantially shorter than the portion 46 overlapping toward the rear. The tightener lever 9 is constructed exactly as in the construction according to FIGS. 1 to 4. In the cross-country skiing position according to FIG. 16, the boot sole rests on the footboard 42 which comprises a covering having a very high friction coefficient, so that the boot is sufficiently secured by means of the static friction in combination with the contact pressure force which is exerted by the tightener lever. In the downhill skiing position according to FIG. 17, the tightener lever 9 is swiveled under the swivel axle 43, wherein the footboard is swiveled forward and rests on the upper side of the tightener lever with its support surface for the boot. For the rest, the construction and support of the tightener lever 9 corresponds to the embodiment form according to FIGS. 1 to 4.

Figure 18:
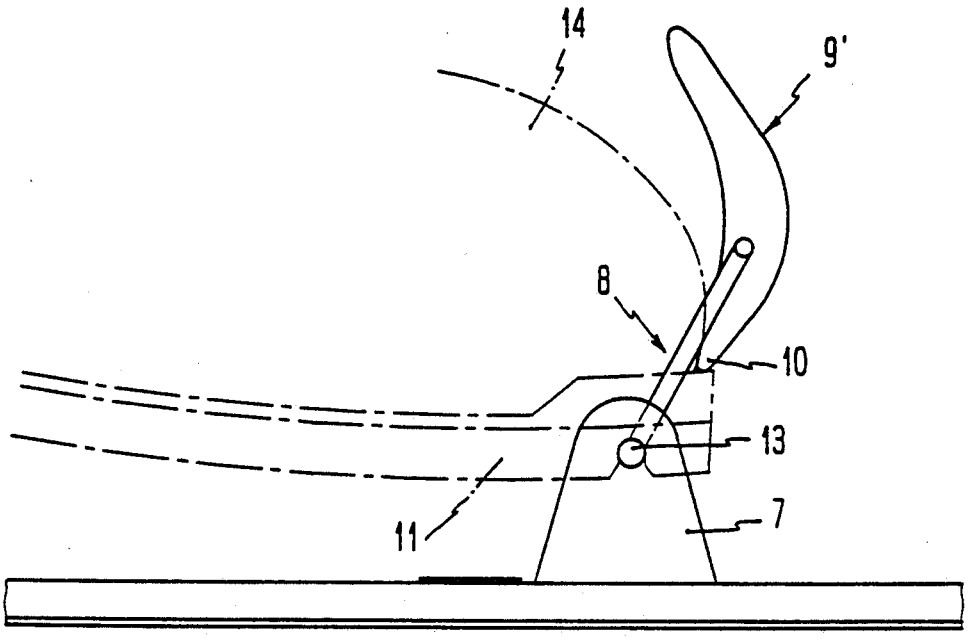
FIG. 18 shows another embodiment form of a sole holding device in a side view in the cross-country skiing position.
Figure 19:
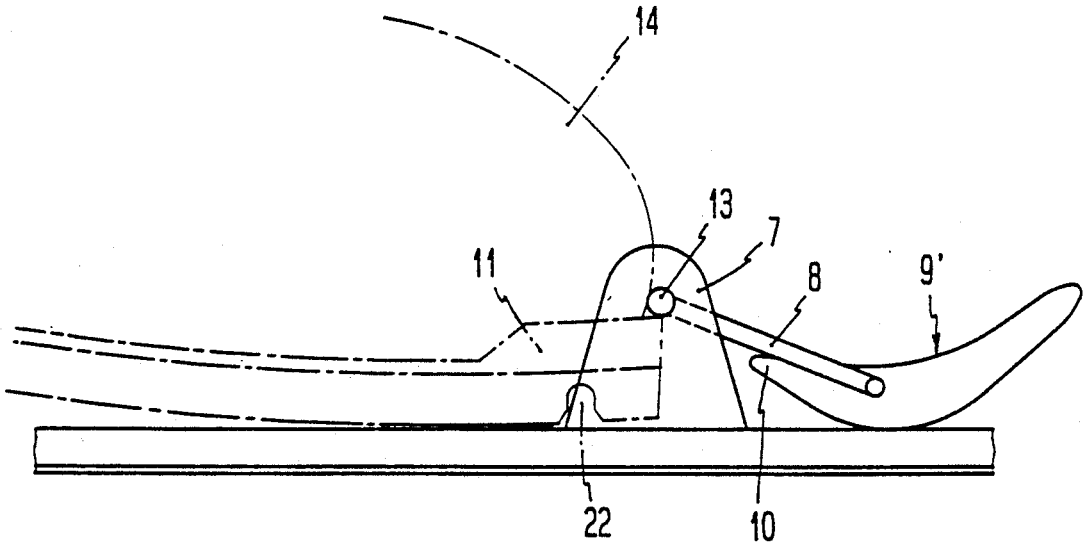
FIG. 19 shows a side view of the binding according to FIG. 18 in the downhill skiing position.

An embodiment form is shown in FIGS. 18 and 19 in which the support bearing and the arrangement of same corresponds to that in FIGS. 1 to 4, but which is combined with a simple tightener lever 9', according to the embodiment form according to FIGS. 12 to 15, which comprises only one pressure piece 10. The tightener lever 9' thus serves only to hold the boot on the support bearing which is constructed as a straight, continuous shaft 13 and is placed down on the ski toward the front for the downhill skiing position which is shown in FIG. 19. The support bearing 13 serves as a sole hold-down device for the downhill skiing position, since this support bearing 13 has a distance from the surface of the ski which corresponds to the distance of the upper sole edge from the surface of the ski, so that the sole 11 can be slid under the support bearing 13 for the downhill skiing position.

Figure 20:
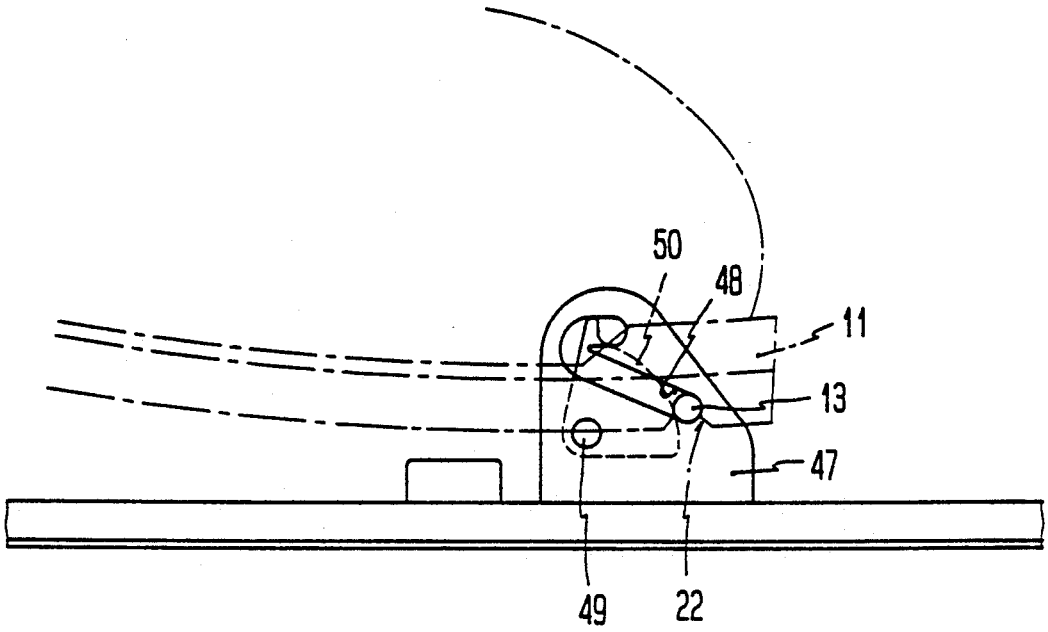
FIG. 20 shows another construction of a front sole holding device in the cross-country skiing position.
Figure 21:
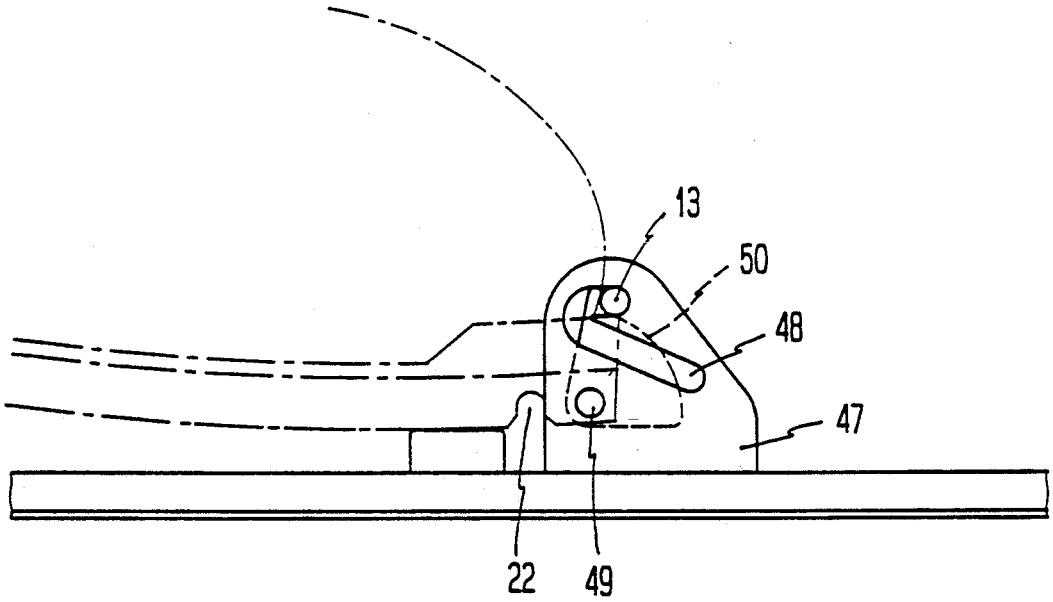
FIG. 21 shows a sole holding device according to FIG. 20 in the downhill skiing position.
Figure 22:
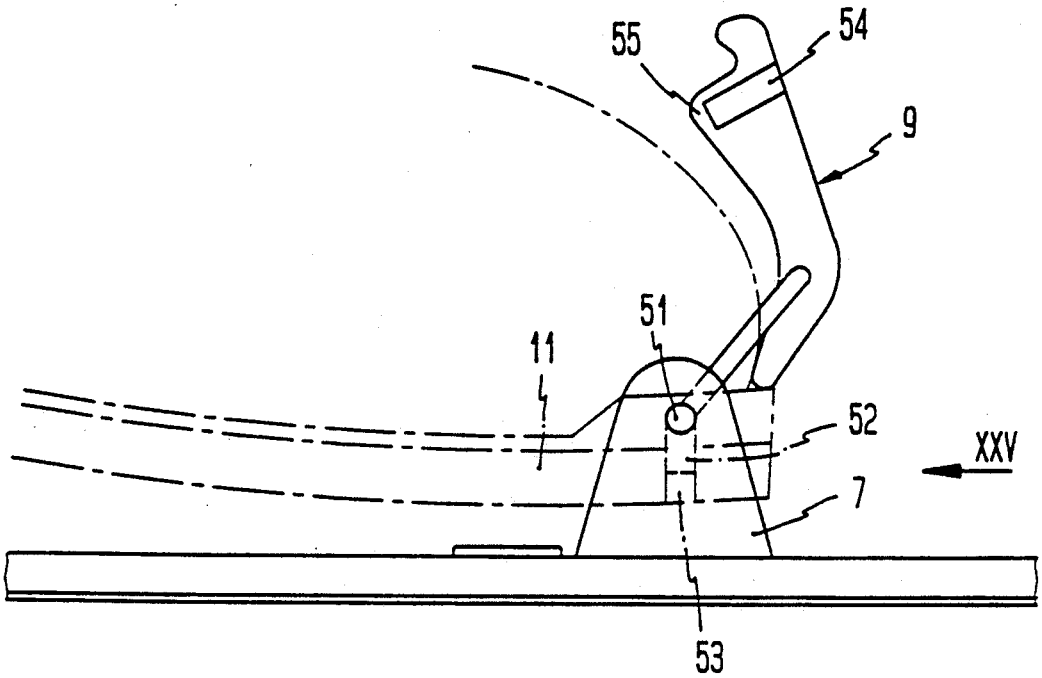
FIG. 22 shows another construction of a front sole holding in the cross-country skiing position.

In the embodiment forms shown in FIGS. 20 and 21, a support bearing 13 is provided which is constructed as a straight shaft and is held in lateral bearing blocks 47 so as to be rotatable and adjustable, just as in the embodiment form according to FIGS. 1 to 4., wherein this support bearing is displaceable in a slot guide 48 from a lower position, in which it serves as a support for the cross-country skiing position, into an upper position in which the support bearing serves as a sole hold-down device, specifically in such a way that the overlapping edge of the sole 11 can be slid under the support bearing 13 which is constructed as a shaft, as follows from FIG. 21. A simple tightener lever 9', as is used in the embodiment form according to FIGS. 12 to 15 or 19 and 20, serves as the tightener lever and comprises a pressure piece 10 only at one end. A rotating slider 50, which is swiveled against the support bearing in the respective end positions of the support bearing 13 and accordingly blocks its displacement, is provided in order to hold the support bearing 13 in the respective position in spite of the slot guide 48, i.e. in order to prevent a displacement of the support bearing due to the forces occurring during cross-country or downhill skiing.

Another construction is shown in FIGS. 22 to 25 in which the support bearing is constructed not in one piece, but in the form of two coaxially aligned pins 51 with bent portions 52 directed downward, i.e. in the direction of the surface of the ski. These pins 51 engage in lateral recesses 53 of the boot sole 11 with their bent portions 52, wherein the recesses open downward and do not extend over the entire height of the boot sole, so that the closed remainder of the boot sole can rest on the pins 51, wherein the bent portions 52 in the recesses 53 serve for an improved lateral stabilization of the boot sole.

Figure 23:
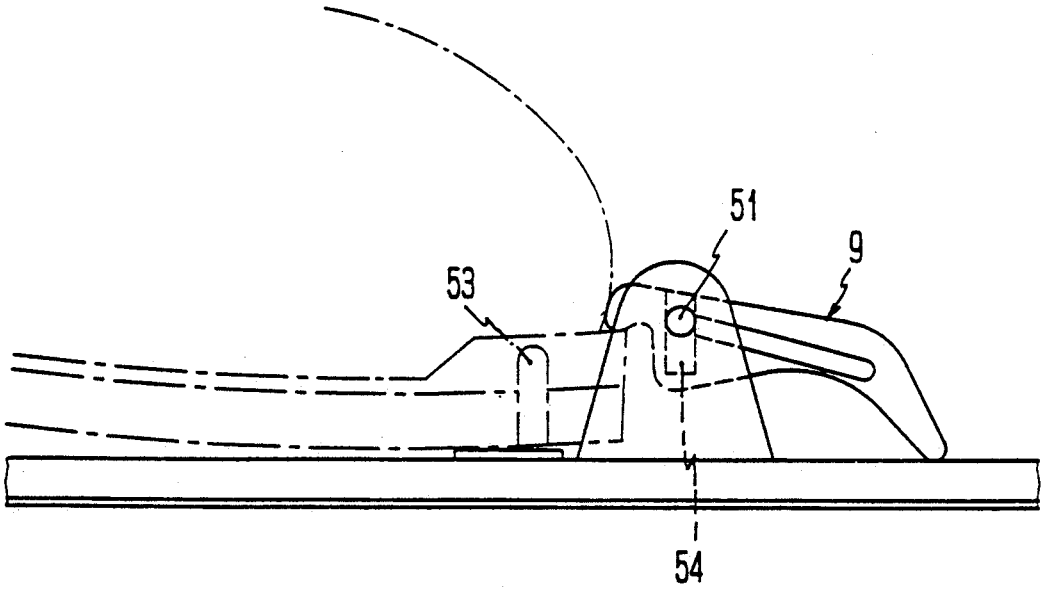
FIG. 23 shows the sole holding device according to FIG. 22 in the downhill skiing position.
Figure 24:
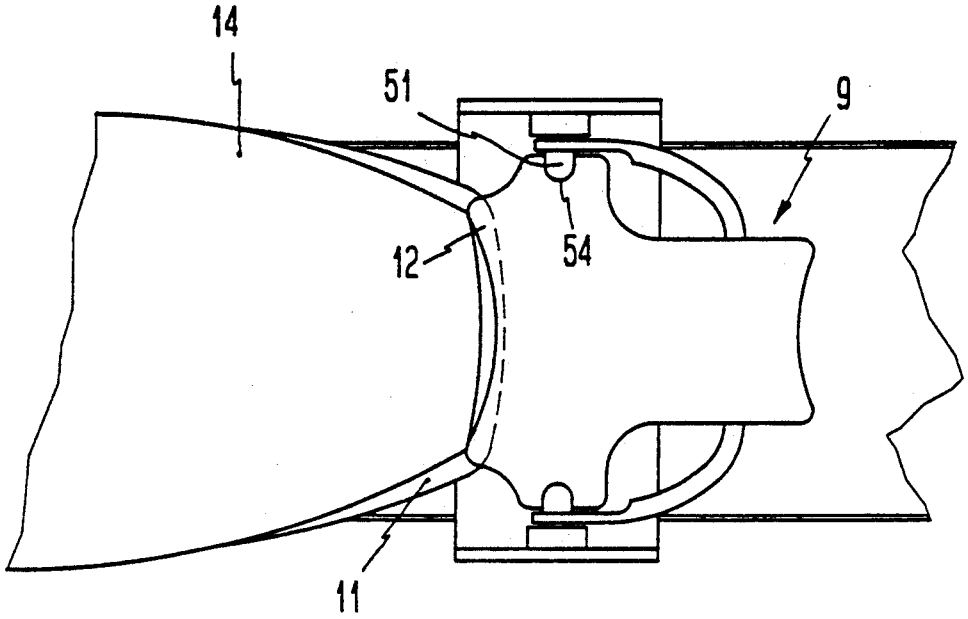
FIG. 24 shows a top view of the sole holding position according to FIG. 23.
Figure 25:
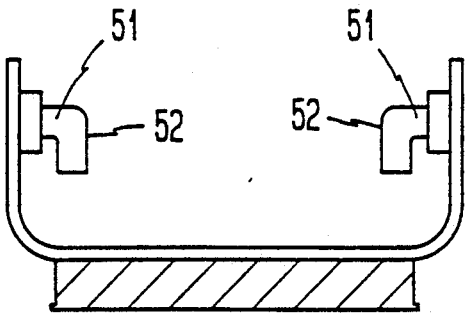
FIG. 25 shows a partial view in the direction of arrow XXV in FIG. 22.

The tightener lever 9 substantially corresponds to the tightener lever 9 according to FIGS. 1 to 4, but comprises recesses 54 in its two side surfaces in which the pins 51 engage with their bent portions 52 in the downhill skiing position, as follows from FIG. 23. Since the recesses 54 are not continuous, the remaining wall part 55 forms a stop for the bent portions 52, so that the tightener lever 9 is held in the downhill skiing position and cannot be deflected upward during upwardly directed forces.

While the foregoing description and drawings represent the preferred embodiments of the present invention, it will be obvious to those skilled in the art that various changes and modifications may be made therein without departing from the true spirit and scope of the present invention.

We claim:

1. Front sole holding device which can be used optionally for cross-country skiing and downhill skiing and can be used in combination with a ski boot which comprises a sole overlapping the ski boot in the front toe area, wherein the ski boot is connected only with the front sole holding device for cross-country skiing, a support bearing holding the ski boot in said front sole holding device at a distance from the surface of the ski, said front sole holding device swivelable around an axis extending transversely relative to the longitudinal direction of the ski and in which the ski boot is being detachably pressed against the front sole holding device by a rear sole holding device for downhill skiing, wherein the support bearing absorbs upwardly directed forces at the overlapping sole, the improvement comprising that said support bearing includes a portion thereof arranged to support the ski boot from the underneath the ski boot for cross-country skiing, said ski boot being placeable on the support bearing from above the support bearing; said support bearing including a clamping device and a supporting member; said supporting member connected with the ski having an element about which said clamping device is swivelable; said clamping device being arranged to act from above an edge of the overlapping sole of the ski boot for clamping the ski boot on the support bearing; and wherein the clamping device is constructed as a two-armed tightener lever which is supported so as to be swivelable by means of tension bars, said tension bars supporting said tightening lever on either side so as to be fixed with respect to the ski, said clamping device comprising a pressure piece at one free end, which pressure piece presses on the upper sole edge in the cross-country skiing position, wherein the point of support of the pressure piece on the sole is located outside the plane of the tension bars at the side remote of the ski boot; and wherein the tightener lever carries a sole hold-down device at its other free end located opposite the pressure piece, which sole hold-down device is designed to accommodate boot sole thickeners and cooperates with the sole edge in the downhill skiing position, and wherein the tightener lever can be locked in the downhill skiing position by means of a locking device so as not to be able to swivel upward.

2. In a front sole holding device which can be used optionally for cross-country skiing and downhill skiing and can be used in combination with a ski boot which comprises a sole overlapping the ski boot in the front toe area, wherein the ski boot is connected only with the front sole holding device for cross-country skiing, a support bearing holding the ski boot in said front sole holding device at a distance from the surface of the ski, said front sole holding device swivelable around an axis extending transversely relative to the longitudinal direction of the ski and in which the ski boot is being detachably pressed against the front sole holding device by a rear sole holding device for downhill skiing, wherein the support bearing absorbs upwardly directed forces at the overlapping sole, the improvement comprising that said support bearing includes a portion thereof arranged to support the ski boot from the underneath the ski boot for cross-country skiing, said ski boot being placeable on the support bearing from above the support bearing; said support bearing including a clamping device and a supporting member; said supporting member connected with the ski having an element about which said clamping device is swivelable; said clamping device being arranged to act from above an edge of the overlapping sole of the ski boot for clamping the ski boot on the support bearing; wherein the support bearing is constructed as a U-shaped shaft having side legs with outwardly bent bearing pins at free ends of the side legs, which bearing pins are supported in lateral bearing blocks so as to rotatable.

3. Front sole holding device according to claim 2 wherein the boot sole comprises continuous cut out portion in the lateral overlapping edges for the positive-locking connection of the ski boot and sole holding device, which cut out portions extend vertically relative to the surface of the sole and are adapted to said side legs of the U-shaped shaft.

4. In a front sole holding device which can be used optionally for cross-country skiing and downhill skiing and can be used in combination with a ski boot which comprises a sole overlapping the ski boot in the front toe area, wherein the ski boot is connected only with the front sole holding device for cross-country skiing, a support bearing holding the ski boot in said front sole holding device at a distance from the surface of the ski, said front sole holding device swivelable around an axis extending transversely relative to the longitudinal direction of the ski and in which the ski boot is being detachably pressed against the front sole holding device by a rear sole holding device for downhill skiing, wherein the support bearing absorbs upwardly directed forces at the overlapping sole, the improvement comprising that said support bearing includes a portion thereof arranged to support the ski boot from the underneath the ski boot for cross-country skiing, said ski boot being placeable on the support bearing from above the support bearing; said support bearing including a clamping device and a supporting member; said supporting member connected with the ski having an element about which said clamping device is swivelable; said clamping device being arranged to act from above an edge of the overlapping sole of the ski boot for clamping the ski boot on the support bearing; and wherein the clamping device is constructed as a two-armed tightener lever which is supported so as to be swivelable by means of tension bars, said tension bars supporting said tightening lever on either side so as to be fixed with respect to the ski, said clamping device comprising a pressure piece at one free end, which pressure piece presses on the upper sole edge in the cross-country skiing position, wherein the point of support of the pressure piece on the sole is located outside the plane of the tension bars at the side remote of the ski boot; wherein the tightener lever can be swiveled under the support bearing for the downhill skiing position, the support bearing serving as a locking device, and wherein the end of the tightener lever carrying the pressure piece is support on the ski.

5. Front sole holding device according to claim 4, wherein a control surface is formed on an arm of the tightener lever carrying the sole hold-down device, the underside of the support bearing resting on this control surface which is constructed so as to slope upward in the direction away from the ski boot when in the downhill skiing position and the tightener lever holds down the edge of the sole of the boot.

6. In a front sole holding device which can be used optionally for cross-country skiing and downhill skiing and can be used in combination with a ski boot which comprises a sole overlapping the ski boot in the front toe area, wherein the ski boot is connected only with the front sole holding device for cross-country skiing, a support bearing holding the ski boot in said front sole holding device at a distance from the surface of the ski, said front sole holding device swivelable around an axis extending transversely relative to the longitudinal direction of the ski and in which the ski boot is being detachably pressed against the front sole holding device by a rear sole holding device for downhill skiing, wherein the support bearing absorbs upwardly directed forces at the overlapping sole, the improvement comprising that said support bearing includes a portion thereof arranged to support the ski boot from the underneath the ski boot for cross-country skiing, said ski boot being placeable on the support bearing from above the support bearing; said support bearing including a clamping device and a supporting member; said supporting member connected with the ski having an element about which said clamping device is swivelable; said clamping device being arranged to act from above an edge of the overlapping sole of the ski boot for clamping the ski boot on the support bearing; and wherein the clamping device is constructed as a two-armed tightener lever which is supported so as to be swivelable by means of tension bars, said tension bars supporting said tightening lever on either side so as to be fixed with respect to the ski, said clamping device comprising a pressure piece at one free end, which pressure piece presses on the upper sole edge in the cross-country skiing position, wherein the point of support of the pressure piece on the sole is located outside the plane of the tension bars at the side remote of the ski boot; and a control cam which cooperates with a pressure piece, which is guided in the tightener lever in a resilient manner, said control cam being arranged at the swivel axle of the tightener lever.

* * * * *